United States Patent [19]

Larsen

[11] 3,944,722

[45] Mar. 16, 1976

[54] ANTENNA MOUNT FOR VEHICLES

[75] Inventor: L. James Larsen, Vancouver, Wash.

[73] Assignee: Larsen Electronics, Inc., Vancouver, Wash.

[22] Filed: Nov. 22, 1974

[21] Appl. No.: 526,148

[52] U.S. Cl. ..... 174/153 A; 343/715
[51] Int. Cl.[2] ..... H01Q 1/32
[58] Field of Search .... 174/152 A, 153 A; 343/715, 343/900

[56] References Cited

UNITED STATES PATENTS

| | | | |
|---|---|---|---|
| 3,123,665 | 3/1964 | Ulrich | 174/153 A |
| 3,145,384 | 8/1964 | Nuttle | 174/153 A |
| 3,276,021 | 9/1966 | Horndasch | 343/715 |

*Primary Examiner*—Eli Lieberman
*Attorney, Agent, or Firm*—Klarquist, Sparkman, Campbell, Leigh, Hall & Whinston

[57] ABSTRACT

An antenna mount for a vehicle includes an insulated base with an internally threaded sleeve defining a central opening in the base. A blind-type clamping assembly threads into the sleeve for anchoring the base to a body panel of a vehicle. The clamping assembly includes a clamp member with a threaded stud and integral oblong clamping flange at the lower end of the stud. A stud nut threaded internally and externally threads onto the stud and into the sleeve for joining the clamping assembly to the base. The stud joins the flange at a position offset from the geometric center of the flange toward one of its ends to subdivide the flange into two flange portions of unequal length so as to facilitate entry of the flange through a smaller than usual installation hole in the vehicle body panel and subsequent clamping of the flange against the underside of the panel through progressive threading of the stud nut into the base. Lead-in conductor cable passages are provided through the clamping assembly and base, and the stud nut and stud provide an anchor for the cable within the base.

7 Claims, 5 Drawing Figures

ANTENNA MOUNT FOR VEHICLES

BACKGROUND OF THE INVENTION

1. Field of the Invention

The present invention relates to a mount for attaching a radio antenna to the roof or other body panel of a vehicle.

2. Description of the Prior Art

Many different types of mobile antenna mounts are available and have been proposed, most of which are complex, difficult to install, and require making a large hold in the automobile roof or other body panel to which the antenna is to be attached. For example, a common size of lead-in electrical conductor cable used in connection with mobile radio antennas is a so-called RG-58A/U type coaxial sheathed cable having an insulated outer sheath, an outer conductor cable within the sheath, an insulated inner sheath, and an inner conductor cable within the inner sheath. Such a conductor cable has a nominal outer diameter of approximately three-sixteenths inch. Many available mobile antenna mounts for accomodating a lead-in cable of this size require drilling a ¾ inch hole in the body panel of the vehicle for insertion of a flange-type clamping portion of the antenna mount and clamping the mount in blind fashion to the underside of the panel. A hole of this size is not only difficult to seal against water, but is also difficult to conceal if the antenna mount is ever removed.

One available type of mobile antenna mount not requiring such a large hole is one having a snap-in type blind anchor. However, such snap-in anchors are not entirely satisfactory because once installed, they are difficult to remove. Also, the effective clamping surface of snap-in anchors must necessarily be small because of the inherent nature of this type of anchor. This results in a relatively uncertain connection which can be inadvertently released if the installation hole should later become enlarged through the effects of vibration or other factors.

Prior mounts of the flange type rely on some sort of clamping flange for gripping the underside of the vehicle body panel. The flange- or shoulder-bearing element typically is carried at the lower end of a threaded stud. The stud is screwed into the antenna base after insertion of the flange through the installation hole to clamp the flange against the underside and the antenna base against the upper side of the panel. The clamping flanges of prior known mounts are symmetrically arranged with respect to the axis of the threaded stud to which it is attached, thereby requiring a hole in the roof having a diameter slightly in excess of the sum of the outer diameter of the stud and one-half the total length of the flange extension beyond the stud.

Examples of various common prior flange and snap-in type mounts as described are shown in a four-page sales brochure entitled "Larsen 150 MHz Mobile Gain Antennas" (Form 73150) published by Larsen Electronics, Inc., of Vancouver, Wash.

Other typical prior mounts are shown in U.S. Pat. Nos. 3,624,662; 3,545,148; 3,492,769; 3,444,313; 3,267,476; 3,076,936; 2,946,842; and 2,786,884, all requiring relatively large-diameter mounting holes in the vehicle roof or other body panel because of their symmetrical clamping structures.

From the foregoing the need for an improved antenna mount of simplified weatherproof construction, providing easy installation and removal and requiring only a small mounting hole for the clamp assembly of such mount, will be apparent.

SUMMARY OF THE INVENTION

The antenna mount of the invention overcomes the foregoing deficiencies of the prior art by providing a simplified, effective and weatherproof base and clamping assembly capable of easy installation through a small mounting hole of one-half the diameter of holes required for prior flange-type mounts. The clamping assembly has only two moving parts — a one-piece clamp member including a threaded clamping stud with integral flange, and a stud nut for threaded engagement with the stud and base.

To provide for insertion of the clamp member through a small installation hole in a body panel of a vehicle, the clamping stud is offset toward one end of an oblong flange from its geometric center, thereby providing long and short flange portions. As a result, the installation hole for the flange need only have a diameter approximating the sum of the stud diameter and the length of the short flange portion. As a practical result, whereas prior flange-type mounts require an installation hole of ¾-inch diameter, the mount of the invention requires a mounting hole of only ⅜-inch diameter, one-half the former size, without sacrificing any clamping strength.

Primary objects of the invention are to provide an antenna mount featuring (1) an improved flange-type clamping assembly requiring a much smaller installation hole than previously required for such assemblies; (2) a strong, effective clamping assembly which resists the loosening effects of vibration; (3) a minimum number of separable parts in the total mounting assembly; (4) quick and easy installation and removal from a vehicle; (5) simple and effective attachment of the lead-in cable; and (6) water and weatherproof construction when installed.

The foregoing and other objects, features and advantages will be more apparent from the following detailed description which refers to the accompanying drawing.

DETAILED DESCRIPTION

Figure 1:
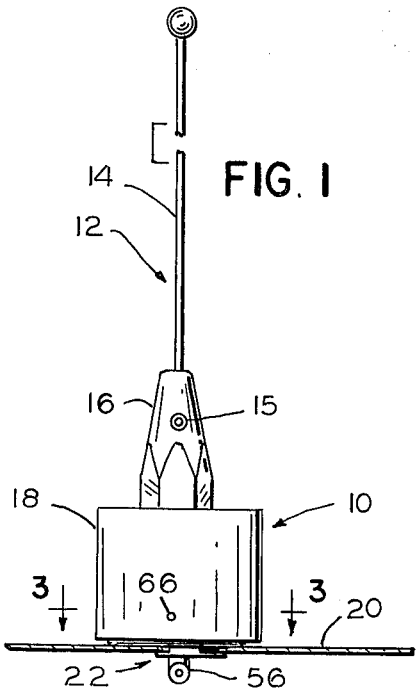
FIG. 1 is an elevational view of a mount of the invention mounting an antenna on the roof of a vehicle.

Referring to the drawing, FIG. 1 shows the antenna mount 10 of the invention mounting an antenna 12 having a rod or whip 14 secured by a set screw 15 to an antenna base 16. Antenna mount 10 includes an insulated base 18 secured to the exterior of the roof or other body panel 20 of a vehicle by a clamping means 22.

Figure 2:
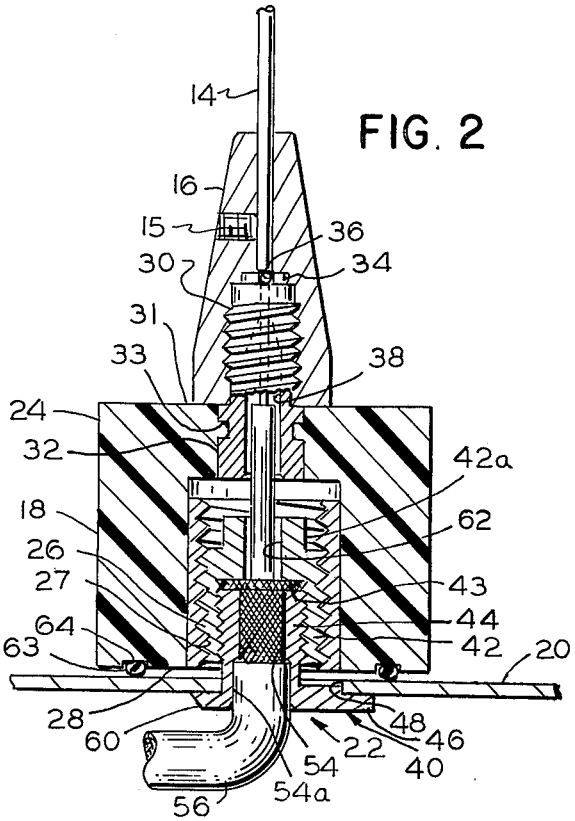
FIG. 2 is a vertical sectional view of the assembly of FIG. 1 on an enlarged scale.
Figure 3:
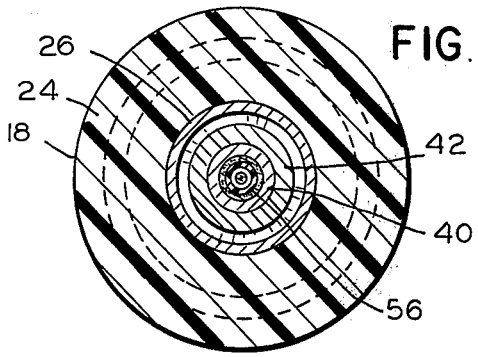
FIG. 3 is a horizontal sectional view taken along the line 3—3 of FIG. 1.

As shown in FIG. 2, mounting base 18 includes a cylindrical insulator housing 24 of epoxy or other suitable moldable dielectric and waterproof material. A brass, internally threaded and externally knurled sleeve 26 is bonded to an interior wall portion of insulator housing 24 to define a large central opening 27 in the housing extending axially inwardly from a flat bottom wall 28.

An antenna mounting means comprising a brass, externally threaded mounting stud 30 projects upwardly from the center of a flat top wall 31 of the insulator housing. The stud has an enlarged base portion 32 within and bonded to housing 24. An annular groove 33 of base portion 32 is filled with insulator material during the bonding process to anchor the stud firmly within the housing. The internally threaded base 16 of antenna 12 is screwed onto stud 30 to secure the antenna to mounting base 18. Stud 30 is topped by a cap portion 34 having a horizontal groove 36 at its upper end for anchoring an inner conductor of the coaxial lead-in cable. An axial cable passage 38 extends through mounting stud 30, such passage being considerably smaller than the larger passage 27 defined by mounting sleeve 26 and forming an upward continuation of the larger one. Stud passage 38 is larger near the base of stud 30 than in its upper portion for a reason that will become clear hereinafter.

Figure 4:
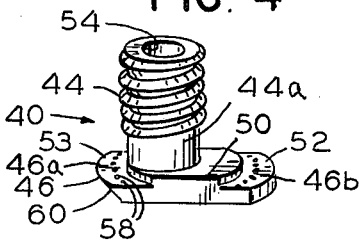
FIG. 4 is a perspective view of the clamping member of the antenna mount shown in the preceding figures.

Referring particularly to FIGS. 2 and 4, the clamping assembly 22 includes a clamping member 40, shown separately in FIG. 4, and an internally and externally threaded clamping or stud nut 42. Clamp member 40 includes an externally threaded clamp stud 44 for receiving stud nut 42 and an integral clamping flange 46 extending laterally from the lower end of the clamp stud. The external threads of stud nut 42 mate with the internal threads of mounting sleeve 26 to provide for screw-threaded attachment of the clamping assembly to base 18.

An important feature of the clamp member 40 is the intersection of an unthreaded lower portion 44*a* of the clamp stud 44 with the upper surface of flange 46 at a position offset from the geometric center of the flange toward one end thereof to subdivide the flange into two flange portions of unequal length, including a short flange portion 46*a* and a much longer flange portion 46*b*. The flange itself is generally oblong as viewed in plan, as will be apparent from FIG. 4, having a width from side to side slightly less than the diameter of the installation hole 48 shown in FIG. 2. The opposite ends of the flange are rounded, which also facilitate entry of the flange through the installation hole.

Figure 5:
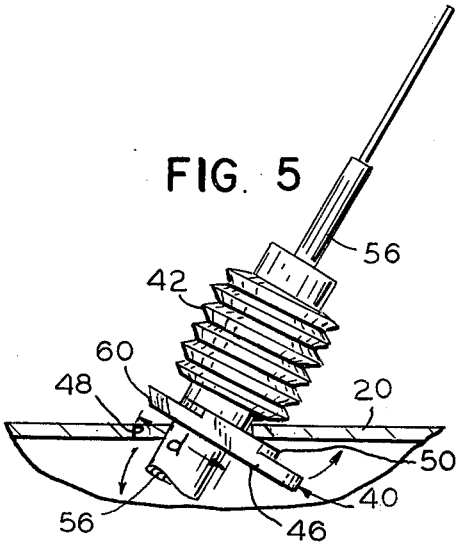
FIG. 5 is a view illustrating a manner of installation of the mount on the roof of a vehicle.

Flange 46 has a raised central boss portion 50 centered on upper surface of the flange. This boss portion is sized so as to fit snugly within the installation hole 48 and thus properly center the flange with respect to the hole so that opposite lip portions 52, 53 extending beyond the boss are properly positioned for engagement with the underside of the vehicle panel 20. Preferably the upper surfaces of the lip portions 52, 53 are dimpled, as shown in FIG. 4, to provide such lips with burrs which help the flange resist rotation relative to the undersurface of body panel 20 as base 18 is threaded onto the clamp assembly during installation. Also because of interference that would otherwise result between the flange and the panel 20 during insertion of the flange through hole 48 in such panel, the short end 46*a* of the flange is beveled at 60 inwardly from its upper surface to its lower surface, as shown in FIGS. 2, 4 and 5.

A lead-in cable passage 54 extends axially through the clamp stud and flange. The lower portion of this passage is slightly larger than the upper portion to receive the full diameter of the lead-in cable including outer sheath. The diameter of the upper portion is reduced to a size so as to receive only a portion of cable having the outer sheath removed, as will be apparent from FIG. 2.

With a clamp member 40 as described, having the eccentric or offset clamping stud 44, the flange portion 46 can be inserted through a much smaller installation opening 48 than would otherwise be required if the stud were centered on the flange. This is illustrated in FIG. 5 where the flange 46 is shown being inserted through installation hole 48 to the underside of roof panel 20. It will be apparent that with the offset stud, the installation hole 48 need only have a diameter approximating the sum of the diameter of the lower unthreaded stud portion 44*a* and the length of the short flange portion 46*a* beyond the stud, or a diameter represented by the distance d from the beveled end 60 of the flange to the farthest point on the stud from such end. If the stud should be centered on the flange rather than offset toward end 60 as shown, the distance *d* would obviously be much greater and thus a much larger diameter hole 48 would be required to insert the flange through the hole.

The lip portions 52, 53 of flange 46 are made as thick as possible without creating interference problems with respect to the roof panel upon their insertion through panel hole 48 to provide such lips with as high a clamping strength as possible. The height of boss 50 above the upper surfaces of the lips in no case should exceed the thickness of the vehicle body panel so that such boss will not protrude above the upper surface of the body panel. In a successful prototype antenna mount for use with a coaxial lead-in cable of the previously mentioned type having a nominal 3/16 -inch diameter, the stud portion of the clamp member has a nominal outer diameter of 0.310 inch, a nominal inner diameter of 0.145 inch at the upper small diameter passage portion, and 0.210 inch at the lower enlarged portion of the passage. The stud is provided with 5/16 –24 thread. The threaded portion of the stud is 0.220 inch long and the unthreaded portion is 0.140 inch long. The overall length of the flange portion is nominally nine-sixteenths inch, the lip portions three thirty-seconds inch each, and the total length of the boss portion is nominally three-eights inch. The offset of the stud from the center flange is such that the short flange portion has a length of three thirty-seconds inch, whereas the long flange portion has a length of approximately seven-sixteenths inch. The thickness of the lip portions is 0.060 inch and the height of the raised boss above the upper surface of the flange lips is 0.025 inch for a maximum flange thickness of 0.085 inch. In the prototype the integral clamp member is made of a lead alloy material and the stud nut is made of brass.

Stud nut 42 has an upper unthreaded cap portion 42*a* with an internal cable passage 62 of smaller diameter than the upper internal passage of the clamping stud. As an example, the diameter of the cap passage is 0.115 inch in the aforementioned prototype. Thus when the stud nut is fully threaded onto the stud, an interior shoulder 43 of the cap portion approaches and overlies the upper end of the stud. The internal passage of the stud nut cap is sized so as to receive only the inner conductor of the lead-in cable and its surrounding sheath, but not the outer braided conductor or its sheath. Thus as the stud nut is threaded onto its stud, shoulder 43 compresses the outer conductor braid of the lead-in cable against the top of the clamp stud in the manner shown in FIG. 2 to secure the cable within the base. However, the inner conductor of the cable and its sheath continues up through the cap and into the base 32 of antenna mounting stud 30.

During installation of the mount on the roof of a vehicle, a water-sealing means is provided between the bottom of the base and the exterior surface of the roof. In the illustrated embodiment, the water-sealing means is an O-ring 63 retained within an annular groove 64 centered about the large interior opening in the bottom of the insulator housing. However, other sealing means could be used, such as a rubber washer.

INSTALLATION

To install an antenna on the roof of an automobile using the mount of the present invention, the following steps are taken:

First, a conventional coaxial lead-in cable, preferably of the type RG–58–A/U, is prepared by removing the vinyl insulating sheath from the cable for a distance of approximately 2 inches from one end, with care being taken not to nick the outer conductor braid. Then the exposed outer conductor braid is pushed back from the unsheathed end to expose the plastic inner sheathing surrounding the inner conductor, after which one-half inch of the inner conductor and its surrounding inner sheath are removed from the same end of the cable. Following this the outer conductor braid is pulled back over the shortened inner plastic sheath and twisted at its outer end to form a small-diameter tip on the outer conductor braid.

Next the prepared end of the cable is threaded through clamp member 40 from the bottom up until the outer sheath of the cable abuts the upper end of the enlarged lower portion of the cable passage in the clamp member, leaving only the unsheathed braid and coaxial inner conductor protruding from the upper end of the clamp member. At this point the braid is pushed back against the top of clamp stud 44, but without permitting any of the conductor braid to hang over the threads of the stud. This leaves only the inner conductor and its surrounding sheath extending far beyond the upper end of the clamp stud. Stud nut 42 is next threaded onto stud 44 and tightened securely to compress the outer conductor braid between the inner shoulder of the nut and the upper end of the stud.

With the lead-in cable thus secured to the clamping assembly, a ⅜-inch hole is drilled at a desired location in a vehicle body panel. For successful blind installation of a clamping assembly having the dimensions previously mentioned, the body panel on which the antenna is to be installed should not exceed 0.070 inch. As shown in FIG. 5, the portion of lead-in cable 56 extending from the bottom of the clamp member is bent sharply against the bottom of the long flange portion and pushed through installation hole 48 with the flange at approximately right angles to the body panel. At the same time long flange portion **46*b* is inserted first into hole 48 and then rotated (counter clockwise in FIG. 5**) to raise the long portion of the flange up beneath the panel while simultaneously lowering the short beveled end of the flange down through the hole.

Next, the one-piece base 18 is threaded onto the stud nut after the inner conductor and its sheath are first threaded upwardly through the axial passage of the antenna mounting stud 30. As the mounting base is threaded onto the stud nut, a slight upward pull is exerted on the lead-in cable and the boss 50. is centered in hole 48 so that flange lips 52, 53 engage the undersurface of panel 20 to resist rotation of the flange during the threading operation. A small hole 66 (see FIG. 1) in the side of the insulator housing is sized to receive a small Allen-type wrench which can be used for final tightening of the mounting base against the exterior surface of the body panel. The base should be tightened until the O-ring seal 63 is compressed between the base and the body panel to form a waterproof seal. The O-ring seal when in compression not only acts as a water seal, but also acts to resist loosening of the base caused by vehicle-induced vibrations.

With the base installed on vehicle panel 20, only the inner conductor of lead-in cable 56 extends from the upper cap end of antenna mounting stud 30. This conductor is bent down into channel 36 of the stud cap, and then wound once around the side of the cap. Although not necessary, the inner conductor may be soldered in place. Following this the antenna base 16 is threaded onto mounting stud 30 to secure the antenna whip to the mount and complete the installation.

Having illustrated and described what is presently a preferred embodiment of my invention, it should be apparent to those skilled in the art that the same permits of modification in arrangement and detail. For example, numerous shapes, sizes and types of insulated bases could be used with the same basic offset clamping member shown. I claim as my invention all such modifications that come within the true spirit and scope of the following claims.

I claim:

1. An antenna mount for a vehicle comprising:

an internally threaded insulator base adapted for mounting on the exterior of a vehicle body panel inculding antenna mounting means at an upper end portion of said base, clamping means for securing said base to said body panel including an externally threaded clamp stud for threaded connection to said base above said panel and an integral thin oblong clamp flange extending laterally in opposite directions from a lower end of said stud for clamping engagement with the underside of said vehicle body panel, said flange having a maximum thickness dimension substantially less than its length and width dimensions, said stud being joined to said flange at a position offset from the geometric center of said flange toward one end thereof so as to enable insertion of said flange portion through a small circular hole in said body panel of only slightly larger diameter than said stud and subsequent clamping of said flange against the underside of said body panel through progressive threading of said stud into said base, said clamping means and said insulator base having a cable passage extending therethrough axially of said clamp stud and base for directing a coaxial lead-in conductor cable into said base and an inner conductor of said cable through said base to said antenna mounting means, and means within said base for clamping an outer conductor of said cable to an upper end of said clamp stud within said base above said panel.

2. A device according to claim 1 wherein said stud intersects said flange at a position so as to divide said flange into two flange portions of unequal length, the shorter of said flange portions having an undercut bevel at the free end thereof to facilitate insertion of said flange portion through said small hole without interference with said body panel.

3. A device according to claim 1 wherein said flange includes a boss portion raised from an upper surface of said flange inwardly of the opposite ends thereof to define a pair of thin panel-engaging lips extending outwardly from said boss portion, said boss portion being sized to fit closely within said small circular hole to center said lips below and beyond opposite ends of said hole, said stud intersecting said boss portion adjacent one end of said boss portion.

4. A device according to claim 1 wherein said means within said base for clamping an outer conductor comprises an externally and internally threaded clamping nut for threaded engagement internally with said clamp stud and externally with said base, said clamping nut having an internal shoulder portion overlying the upper end of said clamp stud for compressing the outer conductor of a coaxial lead-in cable against an upper end of said clamp stud upon threading of said nut onto said clamp stud.

5. A device according to claim 3 wherein said clamping flange is oblong, said clamp stud being centered between the opposite sides of said flange, said lips having flat upper surfaces for engagement with the underside of said body panel, said upper surfaces of said lips being burred to resist rotational movement with respect to said underside.

6. An antenna and coaxial cable mounting assembly for securement within a minimal circular opening of a vehicle panel in blind fashion from the exterior thereof, said assembly comprising:

a clamping member including a thin, oblong flange portion having an upper surface adapted to engage an inner surface of said panel, an integral boss portion extending upwardly from the upper surface of said flange portion between the opposite ends thereof and adapted to substantially fill said opening to center said flange portion below and on opposite sides of said opening, and an externally threaded stud portion extending upwardly from said boss portion to extend above said panel at a position offset from the center and toward one end of said flange portion, said clamping member having a clamp conductor cable passage therethrough from a lower surface of said flange portion to an upper end of said stud portion, a hollow externally and internally threaded clamping nut for threaded engagement with the external threads of said stud portion, said clamping nut having a nut conductor cable passage extending axially therethrough as a continuation of said clamp cable passage, said nut defining an internal shoulder at an intersection of said nut cable passage and its internally threaded portion and overlying the upper end of said stud portion such that upon threading of said nut onto said stud portion the outer conductor of said coaxial cable is compressed between said internal shoulder of said nut and the upper end of said stud portion, an internally threaded insulator base for threaded engagement with the external threads of said clamping nut so as to house said nut and said stud portion above said panel, said insulator housing including antenna connector means at an upper end thereof and an insulator cable passage extending axially therethrough to said antenna connector means as a continuation of said nut and clamp cable passages for passing therethrough the inner conductor of said coaxial cable, and annular resilient fluid sealing means for interposition between a lower end of said insulator base and the outer surface of said panel in surrounding relationship to said stud portion whereby upon threading of said insulator base onto said clamping nut said sealing means is compressed between the lower end of said base and the outer surface of said panel and said flange portion is drawn upwardly against the inner surface of said panel.

7. A mounting assembly according to claim 6 wherein at least an uppermost portion of said clamp cable passage has a first predetermined diameter sufficient to pass therethrough only the outer and inner conductors and the insulation therebetween of said coaxial cable, said nut cable passage having a second predetermined diameter less than said first predetermined diameter for passing therethrough only the inner conductor and surrounding insulation of said coaxial cable, at least the uppermost portion of said insulator cable passage having a third predetermined diameter less than said second predetermined diameter for passing therethrough only the inner conductor of said coaxial cable but not the insulation surrounding said inner conductor.

* * * * *